US008966827B2

(12) United States Patent
Mafi et al.

(10) Patent No.: US 8,966,827 B2
(45) Date of Patent: Mar. 3, 2015

(54) SHELTER ASSEMBLY

(71) Applicant: Mehri Mafi, San Jose, CA (US)

(72) Inventors: Mehri Mafi, San Jose, CA (US); Maryam Mafi, San Jose, CA (US)

( * ) Notice: Subject to any disclaimer, the term of this patent is extended or adjusted under 35 U.S.C. 154(b) by 0 days.

(21) Appl. No.: 14/100,253

(22) Filed: Dec. 9, 2013

(65) Prior Publication Data

US 2014/0245668 A1 Sep. 4, 2014

Related U.S. Application Data

(60) Provisional application No. 61/797,538, filed on Dec. 10, 2012.

(51) Int. Cl.

| | |
|---|---|
| ***E04H 15/14*** | (2006.01) |
| ***E04H 15/22*** | (2006.01) |
| ***E04H 15/20*** | (2006.01) |
| *E04H 4/10* | (2006.01) |

(52) U.S. Cl.

CPC ..... *E04H 15/20* (2013.01); *E04H 15/14* (2013.01); *E04H 4/108* (2013.01); *E04H 2015/201* (2013.01)

USPC ..... 52/2.16; 52/2.22; 52/2.13; 52/2.18

(58) Field of Classification Search

CPC ..... A04H 15/14; A04H 2015/201; A04H 2015/205; A04H 9/10; A04H 15/22; A04H 4/103; A04H 4/108; A04H 15/20

USPC ..... 52/2.16, 2.17, 2.18, 2.22, 2.23, 2.13

See application file for complete search history.

(56) References Cited

U.S. PATENT DOCUMENTS

| | | | | |
|---|---|---|---|---|
| 3,055,379 | A * | 9/1962 | Fink | 52/2.18 |
| 3,170,471 | A * | 2/1965 | Schnitzer | 52/2.19 |
| 3,198,200 | A * | 8/1965 | Sanders | 52/2.18 |
| 5,247,768 | A * | 9/1993 | Russo | 52/2.13 |
| 5,479,743 | A * | 1/1996 | Queen et al. | 52/2.22 |
| 5,603,185 | A * | 2/1997 | Murphy | 52/2.17 |
| 5,642,750 | A * | 7/1997 | Brown et al. | 135/137 |
| 5,860,251 | A * | 1/1999 | Gleich | 52/2.25 |
| 5,893,238 | A * | 4/1999 | Peacock et al. | 52/2.18 |
| 6,269,598 | B1 * | 8/2001 | Wintermantel | 52/220.1 |
| 6,438,900 | B1 * | 8/2002 | Page | 52/2.23 |
| 6,442,903 | B1 * | 9/2002 | Hebert | 52/2.11 |
| 6,565,405 | B2 * | 5/2003 | Hsu et al. | 446/89 |
| 6,708,451 | B1 * | 3/2004 | Gomes | 52/2.17 |
| 7,774,987 | B2 * | 8/2010 | Pfeiffer | 52/2.17 |
| 8,011,986 | B1 * | 9/2011 | Curtsinger | 441/35 |
| 8,096,082 | B2 * | 1/2012 | Moran | 52/2.18 |
| 2002/0083653 | A1 * | 7/2002 | Hilbert | 52/2.17 |
| 2004/0261324 | A1 * | 12/2004 | Tewari | 52/2.18 |
| 2006/0168898 | A1 * | 8/2006 | Chin | 52/2.17 |
| 2011/0203189 | A1 * | 8/2011 | Moran | 52/2.18 |

* cited by examiner

*Primary Examiner* — Phi A

(57) ABSTRACT

A shelter assembly includes a multi-layered, fluid filled shelter that does not require rods for assembly. The assembly includes sidewalls that form a framework for a shelter. The sidewalls comprise air filled materials having a substantially planar shape. The sidewalls form a plurality of layers. Apertures in the sidewalls enable a fluid to pass between each layer for forming an insulating effect on the assembly. The apertures also serve as a cavity for a rod to pass through and fasten the shelter to a surface. A lower floor sidewall and an upper floor sidewall rest adjacent to each other, forming a sandwich configuration that creates insulation and air circulation between layers. At least one channel, such as a chimney, enables an external fluid to circulate through the assembly. A gate portion provides access to the assembly. A roof sidewall provides an external protective upper covering.

13 Claims, 4 Drawing Sheets

SHELTER ASSEMBLY

CROSS-REFERENCE TO RELATED APPLICATIONS

The present Utility patent application claims priority benefit of the U.S. provisional application for patent Ser. No. 61/797,538 titled "Quick Set Up Tent," filed on Dec. 10, 2012 under 35 U.S.C. 119(e). The contents of this related provisional application are incorporated herein by reference for all purposes to the extent that such subject matter is not inconsistent herewith or limiting hereof.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to a shelter assembly. More particularly, the invention relates to a multi-layered fluid filled tent.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a tent is a shelter consisting of sheets of fabric or other material draped over, attached to a frame of poles or attached to a supporting rope. While smaller tents may be free-standing or attached to the ground, large tents are usually anchored using guy ropes tied to stakes or tent pegs.

Typically, an inflatable rubber tent can be inflated with a gas, usually with air, but hydrogen, helium and nitrogen are also used. One of several advantages of an inflatable tent is that it can be stored in a small space when not inflated, since inflatables depend on the presence of a gas to maintain their size and shape.

Often, a sidewall is a vertical structure, usually solid, that defines and sometimes protects an area. Most commonly, a sidewall delineates a building and supports its superstructure, separates space in buildings into sections, or protects or delineates a space in the open air.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A illustrates a shelter assembly with an exemplary upper floor sidewall, and FIG. 1B illustrates a shelter assembly with an exemplary upper floor sidewall and a lower floor assembly, in accordance with an embodiment of the present invention;

Figure 1A:
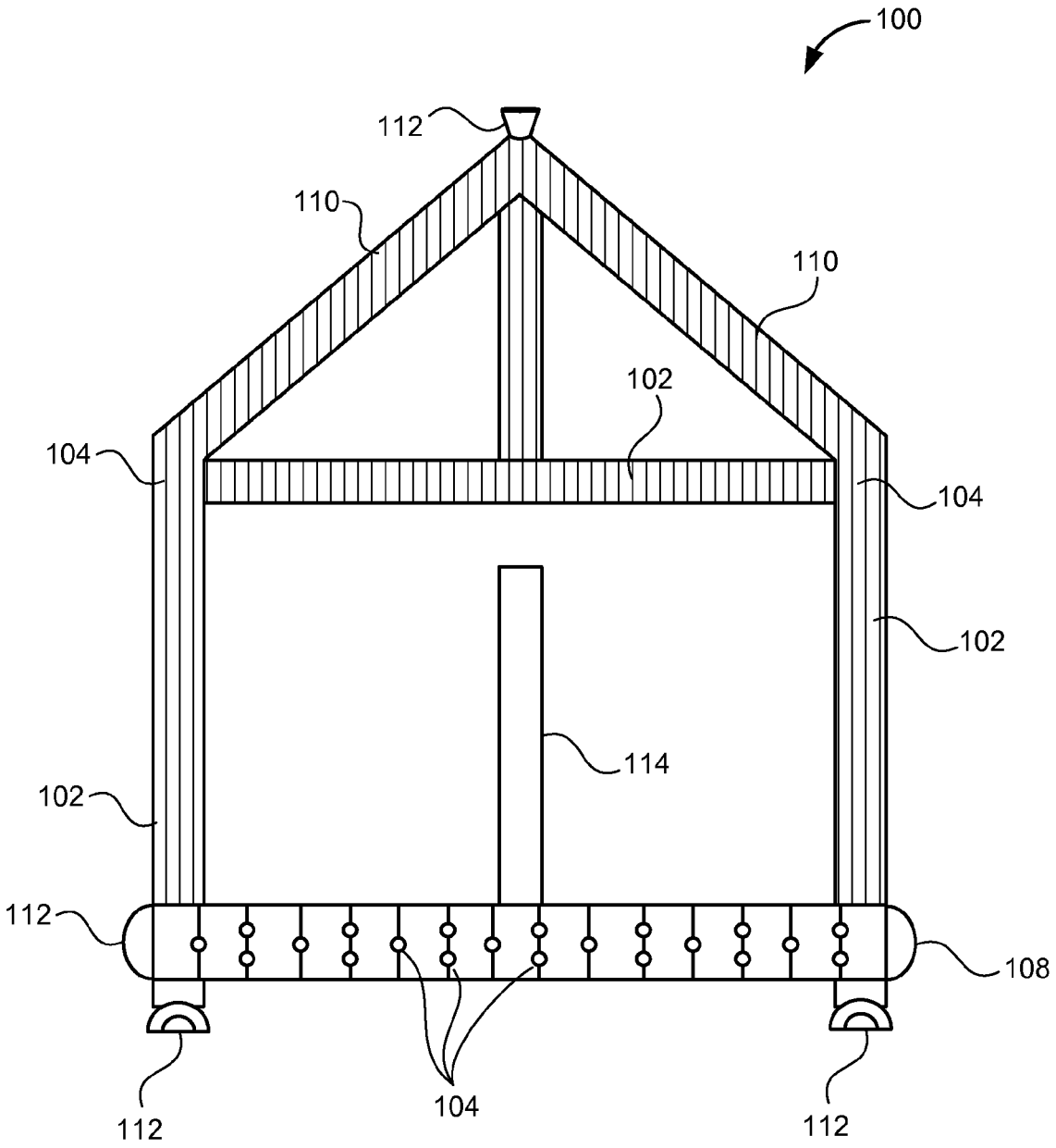
FIGS. 1A and 1B illustrate detailed perspective views of an exemplary shelter assembly, where

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

The present invention will now be described in detail with reference to embodiments thereof as illustrated in the accompanying drawings.

There are various types of shelter assemblies that may be provided by preferred embodiments of the present invention. In one embodiment of the present invention, the shelter assembly may include a multi-layered, fluid filled shelter configured to at least partially receive a fluid and a plurality of rods for assembly and support. In some embodiments, the shelter assembly may fill with a fluid, such as air, to provide enhanced flexibility to contour a ground surface. The lightweight properties of air may also facilitate portability and storage of the shelter assembly. Those skilled in the art, in light of the present teachings, will recognize that the fluid filled characteristics of the shelter assembly preclude the need for a rigid framework and sheets for overlaying throughout the framework.

In some embodiments, the shelter assembly may include at least one sidewall for providing a framework for the shelter assembly. The at least one sidewall may include a fluid filled material having a substantially planar shape. The at least one sidewall may form either a plurality of layers that rest adjacent to each other to form the shelter assembly. The plurality of layers may include two fluid filled sidewalls that rest adjacently to each other, forming a sandwich configuration, e.g., sidewall—fluid—sidewall. In this manner, the plurality of layers may be configured to at least partially enable said fluid to pass between each layer for forming an insulating effect on the shelter assembly.

In one embodiment of the present invention, a plurality of apertures may position throughout the at least one sidewall to perform various functions. In one embodiment, the plurality of apertures may position on two layers of sidewalls to at least partially allow air to pass through, between the layers. This extra space may result in enhanced circulation throughout the shelter assembly. In some embodiments, the plurality of apertures may position on the perimeter of the at least one sidewall for at least partially receiving a rod. The rod may be utilized to securely join the shelter assembly to the ground surface or a mounting surface. For example, without limitation, the corners and longitudinal perimeter of the at least one sidewall may include apertures of various sizes configured to allow nails and stakes to pass through for joining the sidewalls, and also mounting the shelter assembly to a tree and the ground. In yet another embodiment, the plurality of apertures may simultaneously perform the functions of receiving the rods, and allowing air circulation between the at least one sidewall.

In one embodiment of the present invention, the shelter assembly may include at least one sidewall for providing a substantially horizontal lower floor sidewall that engages the ground surface. The lower floor sidewall, like the other sidewalls, may be filled with the fluid. In some embodiments, two or more sidewalls may stack on top of each other. The lower floor sidewall may provide a foundation for supporting the shelter assembly. In some embodiments, the lower floor sidewall may contain sufficient fluid to shape to the ground surface contour, thereby enhancing comfort. The fluid may also elevate the lower floor sidewall such that protrusions, insects, and uncomfortable temperatures may not reach the interior of the shelter assembly. An upper floor sidewall may position adjacent to, and above the lower floor sidewall. A user may rest on the upper floor sidewall, which forms a part of the interior of the shelter assembly. In one embodiment, at least one channel may position adjacently to the sidewalls. The at least one channel may allow an exterior fluid to enter the shelter assembly for circulation throughout the shelter assembly.

In one embodiment of the present invention, the at least one sidewall may join to form a wall structure. The wall structure may include multiple layers for enhanced insulation against cold temperatures, sound, and insects. Those skilled in the art, in light of the present teachings, will recognize that in cold weather, multiple sidewalls may form the wall structure to help insulate against wind and cold. Those skilled in the art, in light of the present teachings, will recognize that wall structures in cold weather may include a thicker material for the sidewalls, and the joint and corners between sidewalls may require a tight seal. In some embodiments, a roof sidewall may position on the at least one sidewall. The roof sidewall may join to form a substantially horizontal or peaked roof that positions perpendicularly to the sidewalls. In any configuration though, the plurality of apertures are disposed to position such that any combination of the sidewalls may be joined with rods that pass through the plurality of apertures that run through the air filled sidewalls. In some embodiments, rather than the plurality of apertures, the sidewalls may include an airtight tube that sets adjacently to the sidewall for at least partially receiving the rod. The tube may have sufficient fluid so that a rigid framework to receive the rod is formed. In some embodiments, a gate portion may provide an opening for the shelter assembly. The gate portion may include, without limitation, a door, a zipper, a smaller sidewall, and a magnet.

Figure 1B:
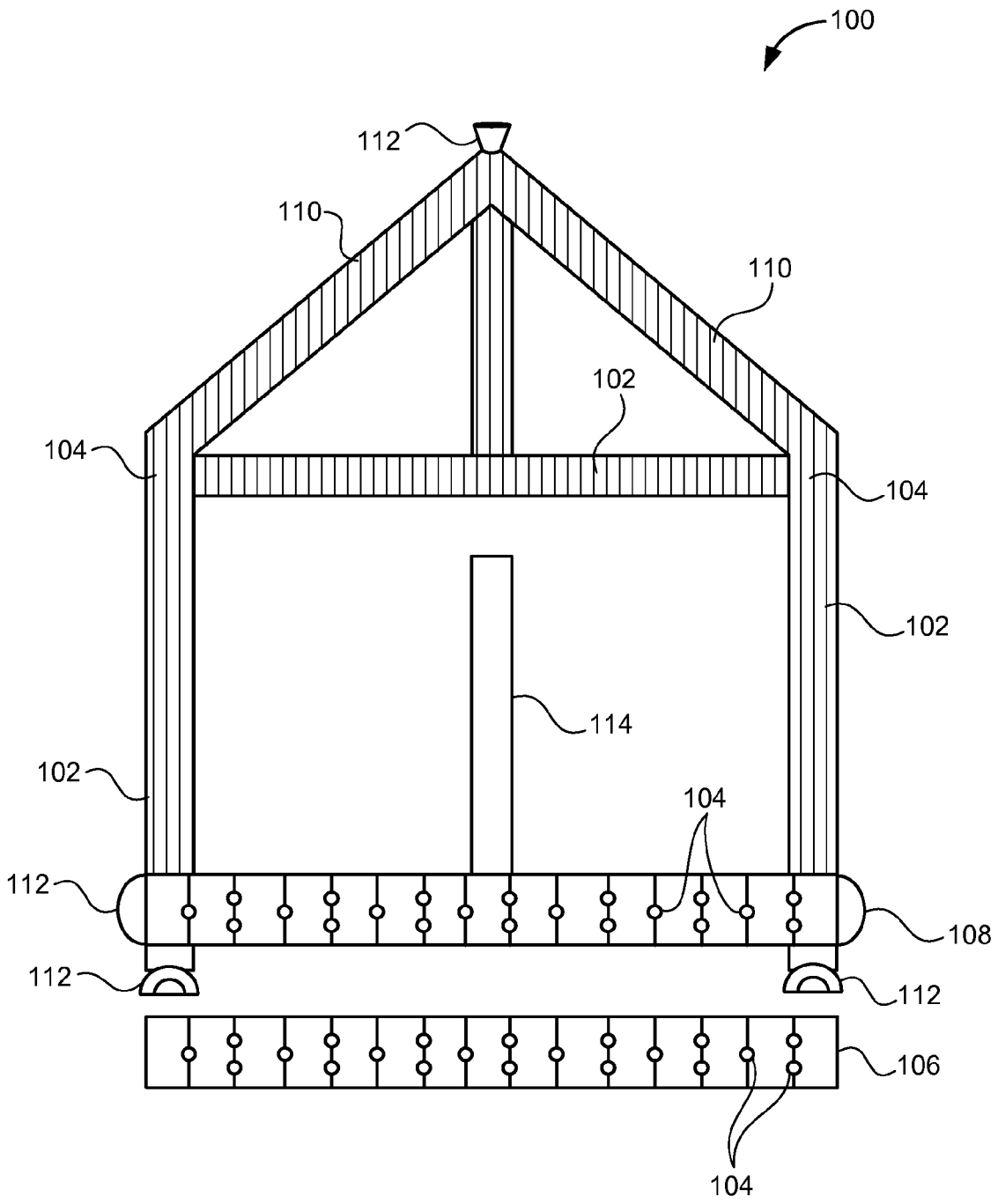

FIGS. 1A and 1B illustrate detailed perspective views of an exemplary shelter assembly, where FIG. 1A illustrates a shelter assembly with an exemplary upper floor sidewall, and FIG. 1B illustrates a shelter assembly with an exemplary upper floor sidewall and a lower floor assembly, in accordance with an embodiment of the present invention. In the present invention, a shelter assembly 100 may include a multi-layered, fluid filled shelter configured to at least partially receive a fluid and a plurality of rods for assembly and support. In some embodiments, the shelter assembly may fill with a fluid, such as air, to provide enhanced flexibility to contour a ground surface. Suitable materials for the shelter assembly may include a tough, flexible material having sufficient strength to receive a high pressure gas. In some embodiments, the fluid may include a gas that provides an insulated filling for the shelter assembly. The shelter assembly may be filled with fluids, including, without limitation, air, water, hydrogen, helium and nitrogen. The shelter assembly may be stored in a small space when not inflated. Suitable materials for the shelter assembly may include, without limitation, synthetic rubber, rubber, latex, and plastic. The lightweight properties of the fluid may facilitate portability of the shelter assembly. Those skilled in the art, in light of the present teachings, will recognize that the lightweight air filled characteristics of the shelter assembly preclude the need for a rigid framework and sheets for overlaying throughout the framework.

In some embodiments, the shelter assembly may include at least one sidewall 102 for providing a framework of a shelter. The at least one sidewall may be joined in myriad combinations to form a variety of shapes for the shelter assembly, including, without limitation, a cube, a rectangle, a pyramid, an oval, and a cube with a peaked roof. The at least one sidewall may include a fluid filled material having a substantially planar shape. The at least one sidewall may form a plurality of layers. The plurality of layers may include two air filled sidewalls that rest adjacently to each other, forming a sandwich configuration, e.g., sidewall-fluid-sidewall. The fluid may help insulate between each layer. In this manner, additional insulation and air circulation may be achieved simply by the manufacture and configuration of the at least one sidewall.

In one embodiment of the present invention, a plurality of apertures 104 may position throughout the at least one sidewall for various functions. In one embodiment, the plurality of apertures may position on two layers of sidewalls to at least partially enable a fluid to pass through, between the layers. This extra space may result in enhanced circulation and insulation throughout the shelter assembly. Additionally, the plurality of layers may be configured to at least partially enable the fluid to pass between each layer for forming an insulating effect on the shelter assembly. In some embodiments, the plurality of apertures may position on the perimeter of the at least one sidewall for at least partially receiving a rod. The rod may be utilized to securely join the shelter assembly to the ground surface or a mounting surface. For example, without limitation, the corners and longitudinal perimeter of the at least one sidewall may include apertures of various sizes configured to allow nails and stakes to pass through for joining the sidewalls, and mounting the shelter assembly to a tree and the ground. In yet another embodiment, the plurality of apertures may simultaneously perform the functions of receiving the rods, and allowing air circulation between the at least one sidewall.

In any configuration though, the plurality of apertures may disposed to position such that any combination of the sidewalls may be joined with rods that pass through the plurality of apertures that run through the air filled sidewalls. In some embodiments, rather than the plurality of apertures, the at least one sidewall may include an airtight tube that sets adjacently to the sidewall for at least partially receiving the rod. The tube may have sufficient air so that a rigid framework to receive the rod is formed.

In one embodiment of the present invention, the shelter assembly may include at least one sidewall for providing a substantially horizontal lower floor sidewall that engages the ground surface. The lower floor sidewall, like the other sidewalls, may be filled with the fluid. However, in some embodiments, each layer may utilize a different fluid for regulating firmness. In some embodiments, two sidewalls stacked on top of each other. In one embodiment, a lower floor sidewall 106 may provide a foundation for supporting the rest of the shelter assembly. The lower floor sidewall may be sufficiently full of the fluid to contour the ground surface, thereby enhancing comfort. The fluid may also elevate the lower floor sidewall such that protrusions, insects, and uncomfortable temperatures may not reach the interior of the shelter assembly. The lower floor sidewall may include a plurality of apertures for at least partially receiving a rod. The rod, or multiplicity of rods, may help secure the assembly to the ground surface. An upper floor sidewall 108 may position adjacent to, and above the lower floor sidewall. In some embodiments, a user may rest on the upper floor sidewall, which forms a part of the interior of the shelter assembly.

In one embodiment, at least one channel 112 may position adjacent to the at least one sidewall. The at least one channel may allow an external fluid, such as the wind or air, to circulate through the shelter assembly. For example, without limitation, the at least one channel may include a chimney that positions above the shelter assembly. In another embodiment, a wall channel may position between the joints and corners of the at least one sidewall. In yet another embodiment having the at least one channel, a floor channel may provide circulation of the external fluid towards the ground surface. The at least one channel may be sized and configured to receive wind. In one embodiment, the at least one channel may include sufficient curvature or bend to carry the wind around the shelter assembly.

In one embodiment of the present invention, the at least one sidewall may join to form a wall structure. The wall structure may include multiple layers for enhanced insulation against cold temperatures, sound, and insects. Those skilled in the art, in light of the present teachings, will recognize that in cold weather, multiple sidewalls may form the wall structure to help insulate against wind and cold. Those skilled in the art, in light of the present teachings, will recognize that wall structures in cold weather may include a thicker material for the sidewalls, and the joint and corners between sidewalls may require a tight seal. In some embodiments, a roof sidewall 110 may position on the at least one sidewall. The roof sidewall may form a protective external cover for the assembly. In one embodiment, the roof sidewall may form a substantially horizontal or peaked roof that positions perpendicularly to the at least one sidewall.

In some embodiments, a gate portion 114 may regulate access to the shelter assembly by providing an opening. The gate portion may include, without limitation, a door, a zipper, a smaller sidewall, and a magnet. In some embodiments, the gate portion may be configured to increase or decrease air pressure so that a space may be formed for entering and exiting the shelter assembly.

Figure 2:
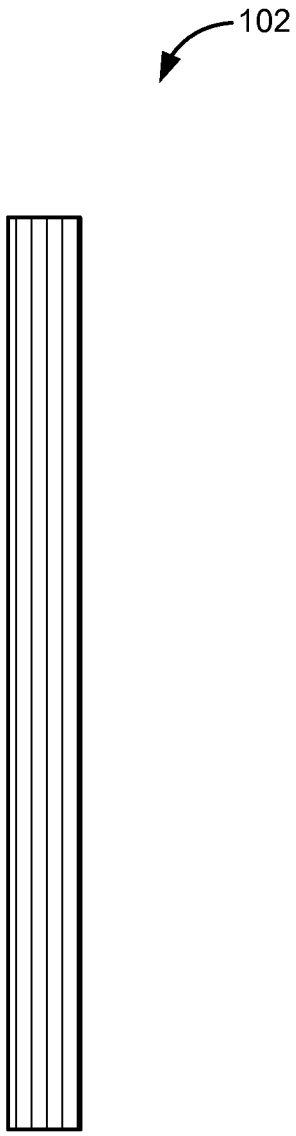
FIG. 2 illustrates a side view of an exemplary sidewall, in accordance with an embodiment of the present invention.

FIG. 2 illustrates a side view of an exemplary sidewall, in accordance with an embodiment of the present invention. In the present invention, the shelter assembly may include at least one sidewall for providing a substantially horizontal lower floor sidewall that engages the ground surface. The lower floor sidewall, like the other sidewalls, may be filled with the fluid. The fluid may pass between each layer or sidewall to create an insulating effect. However, in other embodiments, any fluid efficacious for filling the lower floor sidewall and producing sufficient rigidity to support the assembly may be utilized.

Figure 3:
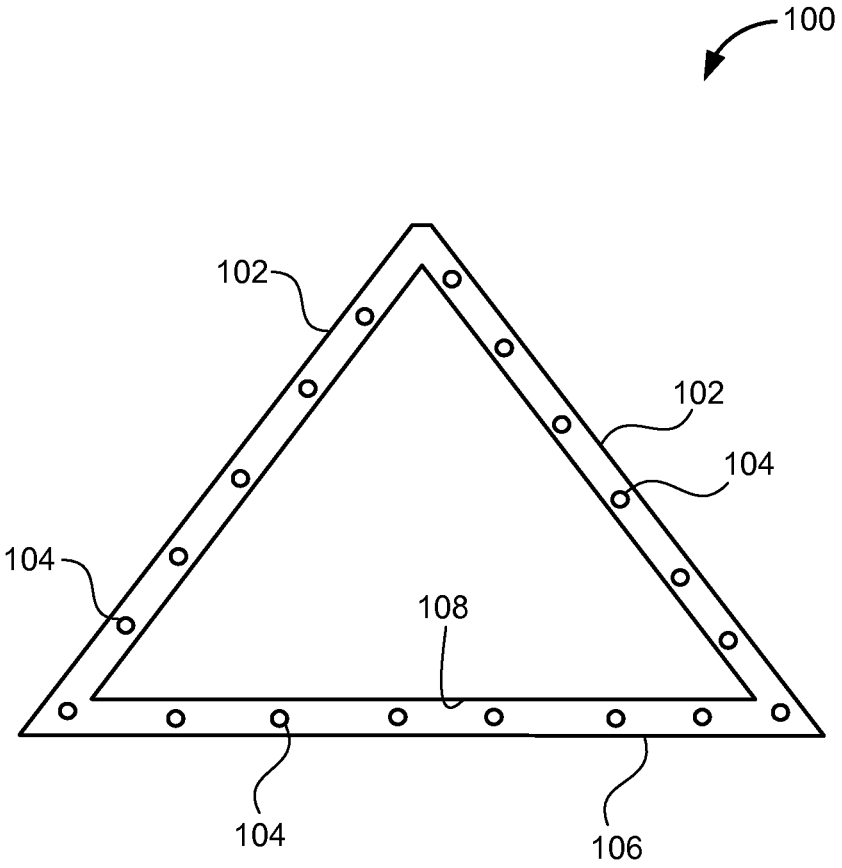
FIG. 3 illustrates a side view of an exemplary alternate design for a shelter assembly, in accordance with an embodiment of the present invention.

FIG. 3 illustrates a side view of an exemplary alternate design for the shelter assembly, in accordance with an embodiment of the present invention. In the present invention, an alternate embodiment for the shelter assembly may include a multi layered floor sidewall, where the upper and lower floor sidewalls join to form a thin, unitary sidewall. A divider may separate the two floor sidewalls. The plurality of apertures may position on the divider to at least partially allow the fluid to circulate between the two floor sidewalls. In some embodiments, the at least one sidewall and the roof sidewall may also utilize the floor sidewall configuration, with two thin, adjacent sidewalls having a divider with apertures in between.

In one alternative embodiment, the at least one sidewall may be filled with helium so that the shelter assembly at least partially floats. In yet another alternative assembly, the plurality of apertures includes a perimeter of water to help cool the air as it flows past each aperture. In yet another alternative embodiment, the floor sidewall includes more than two layers. In yet another alternative embodiment, the lower floor sidewall is filled with a different fluid/gas than the upper sidewall; whereby the lower sidewall is more rigid for engaging the ground surface, and the upper floor sidewall is softer for a user to rest on. In yet another alternative embodiment, the roof sidewall may include a large aperture configured to at least partially allow smoke to pass through.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing an air filled shelter having multiple layers and apertures for air circulation and assembly according to the present invention will be apparent to those skilled in the art. Various aspects of the invention have been described above by way of illustration, and the specific embodiments disclosed are not intended to limit the invention to the particular forms disclosed. The particular implementation of the air filled shelter having multiple layers and apertures for air circulation and assembly may vary depending upon the particular context or application. By way of example, and not limitation, the air filled shelter having multiple layers and apertures for air circulation and assembly described in the foregoing were principally directed to a tent filled with air, and having multiple layers for insulation and contouring the ground surface implementations; however, similar techniques may instead be applied to permanent building structures, such as offices, houses, and warehouses filled with air and having multiple rigid layers, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An assembly comprising:

at least one sidewall, said at least one sidewall being configured to provide a shelter framework for said assembly, said at least one sidewall further being configured to contain a fluid, said at least one sidewall comprising a plurality of layers, said plurality of layers being configured to at least partially enable said fluid to pass between each layer, said at least one sidewall further comprising a plurality of apertures, said plurality of apertures being configured to enable said fluid to pass between said plurality of layers, said plurality of apertures further being configured to at least partially enable a rod to at least partially pass through for fastening said assembly to a surface, said at least one sidewall further comprising at least one channel for at least partially enabling an exterior fluid to circulate through said assembly, and said at least one channel comprises a chimney.

2. The assembly of claim 1, in which said assembly comprises a shelter assembly.

3. The assembly of claim 2, in which said shelter assembly comprises a tent.

4. The assembly of claim 3, in which said fluid comprises a gas.

5. The assembly of claim 4, in which said at least one sidewall comprises at least one air tight rubber tube.

6. The assembly of claim 5, in which said at least one sidewall comprises a lower floor sidewall for providing support to said assembly, said lower floor sidewall comprising said plurality of apertures for at least partially enabling said rod to pass for fastening said assembly to said surface.

7. The assembly of claim 6, in which said at least one sidewall comprises an upper floor sidewall for supporting a user, said upper floor sidewall being disposed to position adjacent to said lower floor sidewall.

8. The assembly of claim 7, in which said at least one sidewall comprises a roof sidewall for forming an external upper covering for said assembly.

9. The assembly of claim 8, in which said at least one sidewall comprises a gate portion for regulating access to said assembly.

10. The assembly of claim 9, in which said gate portion comprises a door.

11. The assembly of claim 10, in which said external fluid comprises wind.

12. An assembly consisting of:

means for providing a shelter with an assembly;

means for filling at least one sidewall with a fluid;

means for arranging said at least one sidewall into a plurality of layers;

means for at least partially enabling said fluid to pass between said plurality of layers;

means for insulating said assembly;

means for engaging a surface with a lower floor sidewall;

means for engaging a user with an upper floor surface;

means for regulating access to said assembly with a gate portion; and means for enabling an external fluid to circulate through said assembly from above the assembly.

13. An assembly consisting of:

at least one sidewall, said at least one sidewall comprising an airtight rubber tube, said at least one sidewall being configured to provide a shelter framework for said assembly, said at least one sidewall further being configured to contain a fluid, said fluid comprising air, said at least one sidewall comprising a plurality of layers, said plurality of layers being configured to at least partially enable said fluid to pass between each layer for forming an insulation for said assembly, said at least one sidewall further comprising a plurality of apertures, said plurality of apertures being configured to enable said fluid to pass between said plurality of layers, said plurality of apertures further being configured to at least partially enable a rod to at least partially pass through for fastening said assembly to a surface, said at least one sidewall further comprising a lower floor sidewall for providing support to said assembly, said lower floor sidewall comprising said plurality of apertures for at least partially enabling said rod to pass for fastening said assembly to said surface, said at least one sidewall further comprising an upper floor sidewall for supporting a user, said upper floor sidewall being disposed to position adjacent to said lower floor sidewall, said at least one sidewall further comprising a roof sidewall for forming an external upper covering for said assembly, said at least one sidewall further comprising a gate portion for regulating access to said assembly, said gate portion comprising a door, said at least one sidewall further comprising at least one channel for at least partially enabling an external fluid to circulate through said assembly, said at least one channel comprising a chimney, said external fluid comprising wind.

* * * * *